US007914095B2

(12) United States Patent
Hayasaki

(10) Patent No.: US 7,914,095 B2
(45) Date of Patent: Mar. 29, 2011

(54) HEAD ELEMENT SUBSTRATE, RECORDING HEAD, AND RECORDING APPARATUS

(75) Inventor: Kimiyuki Hayasaki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 166 days.

(21) Appl. No.: 12/337,646

(22) Filed: Dec. 18, 2008

(65) Prior Publication Data

US 2009/0160892 A1 Jun. 25, 2009

(30) Foreign Application Priority Data

Dec. 21, 2007 (JP) ..... 2007-330950

(51) Int. Cl.
*B41J 29/38* (2006.01)

(52) U.S. Cl. ..... 347/10; 347/9; 347/12

(58) Field of Classification Search ..... 347/10
See application file for complete search history.

(56) References Cited

U.S. PATENT DOCUMENTS

| | | | | |
|---|---|---|---|---|
| 4,628,327 | A * | 12/1986 | Anderson et al. | 346/33 ME |
| 5,907,331 | A | 5/1999 | Markham | |
| 6,116,714 | A * | 9/2000 | Imanaka et al. | 347/19 |
| 6,830,301 | B2 | 12/2004 | Hayasaki | |
| 7,029,084 | B2 | 4/2006 | Schloeman | |
| 2002/0003816 | A1 * | 1/2002 | Nabesako et al. | 370/542 |
| 2009/0160892 | A1 | 6/2009 | Hayasaki | |

FOREIGN PATENT DOCUMENTS

| | | |
|---|---|---|
| EP | 670219 | 9/1995 |
| EP | 1128324 | 8/2001 |
| JP | 06-009255 U | 2/1994 |

* cited by examiner

*Primary Examiner* — Matthew Luu
*Assistant Examiner* — Brian J Goldberg
(74) *Attorney, Agent, or Firm* — Canon USA Inc IP Div

(57) ABSTRACT

A head element substrate includes receiving means for receiving data in which recording data and drive pulse width data have been multiplexed, a shift register which separates recording data from the multiplexed data, and a drive pulse width signal generation circuit which generates a drive pulse width signal by separating the drive pulse width data from the multiplexed data.

10 Claims, 18 Drawing Sheets

HEAD ELEMENT SUBSTRATE, RECORDING HEAD, AND RECORDING APPARATUS

BACKGROUND OF THE INVENTION

1. Field of the Invention

The present invention relates to a head element substrate, a recording head, and a recording apparatus. More particularly, the present invention relates to a head element substrate which has an electrothermal transducer for generating the heat energy necessary to record an image and a drive circuit for driving the electrothermal transducer formed on the same substrate, a recording head provided with the head element substrate, and a printing apparatus using the recording head.

2. Description of the Related Art

For an inkjet recording apparatus, a recording head including a discharge port and an electrothermal transducer which generates discharge energy for discharging ink from the discharge port as a recording element is known. Such a recording apparatus records an image by discharging ink based on the desired recording information.

As the configuration of the recording head of an inkjet recording apparatus, a recording head provided with a plurality of recording elements in one array or in a plurality of arrays has conventionally been known. Generally, the recording elements in such a recording head and the drive circuits thereof are formed on the same substrate using semiconductor fabrication process technology.

As a method for driving a recording head, time-division driving is practically used. Since there is an upper limit on the maximum consumed power which can simultaneously drive the recording elements, time-division driving is employed in which a plurality of recording elements are divided into M blocks formed from N recording elements, and N recording elements are simultaneously driven per block. This driving method will now be described with a specific circuit configuration employed in time-division driving.

FIG. 16 is an equivalent circuit diagram of a conventional head element substrate. A head element substrate 100 includes a data terminal, a clock terminal, a latch terminal, and a heat signal terminal. Further, the following features are built into the head element substrate 100 as a drive circuit 103: a shift register 21 for holding recording data and block control data; a latch circuit 22 which latches the held data; an AND circuit 23 which calculates the logical product of an output signal from the latch circuit and a signal from a heat signal terminal; a decoder 24 which outputs a signal for selecting a block; an AND circuit 25 which selects a recording element 27 to be driven; a switching element 26 for driving the recording element and the like. In a recording element array 102, recording elements are arranged in line, sharing a power source VH and GND with one another.

Data in which recording data and block control data are serially combined is input from the data terminal, and a clock for transferring the data is input from the clock terminal into the drive circuit 103 respectively. Further, from the latch terminal, a latch signal which latches data held in the shift register 21 is input, and from the heat signal terminal, a heat signal as a drive pulse width signal which defines the power-on period of a recording element, is input into the drive circuit 103.

FIG. 17 illustrates a timing chart representing the communication state of the drive circuit 103. As illustrated in FIG. 17, in the present specification, the period from data transfer start of a first block to data transfer start of the next first block is referred to as a "drive period". Further, the period from data transfer start of a first block to data transfer start of a second block in the same drive period is referred to as a "block period". Data corresponding to one block of recording elements is transferred per block period, and data corresponding to one array of recording elements is transferred in one drive period.

The data (DATA) of the first block is input into the shift register 21 by a clock (CLK). Then, based on the latch signal (LAT), recording data and block control data held in the shift register 21 are output from the latch circuit 22. The logical product of the recording data of the first block output from the latch circuit 22 and the heat signal (HEAT) which is input while the data of the second block is being transferred is calculated by the AND circuit 23. On the other hand, the block control data of the first block is input into the decoder 24, and based on that input, a block selection signal BLE is output from the decoder. The logical product of this block selection signal BLE and the output signal of the AND circuit 23 is calculated by the AND circuit 25. If that output signal is active, the switching element 26, which is a MOS transistor or the like, is selected and driven. A recording operation is thus performed by selecting a recording element corresponding to the recording data and the block control data, and energizing the recording element to discharge ink from a nozzle. This operation is repeated from the first block to the $M^{th}$ block to record one array of a recording element.

Further, with respect to a recording head mounted with a head element substrate, a recording head provided with one array of recording elements, or a plurality of arrays of recording elements has conventionally been known. In such a recording head, with N recording elements as one block, multiple or several tens of drive circuits which can be simultaneously driven are mounted on the same head element substrate. By arraying recording data so as to correspond to a respective recording element, inputting the recording data into the recording head, and driving the recording elements, arbitrary recording can be performed on a recording medium such as recording paper.

Recording head performance has dramatically improved in recent years while the precision is increased and the image quality is improved. On the other hand, along with this increased precision and improved image quality, the number of recording elements has grown, or the number of simultaneous drives of the recording elements has grown in order to improve the recording rate. As a result, the number of connection terminals between the recording head and the recording apparatus main unit has increased, which has led to various problems such as an increase in the cost of the connector unit between the recording head and the recording apparatus main unit, and contact point defects in the connection portion.

As a method for reducing the number of connection terminals, in U.S. Pat. No. 6,830,301, the number of connection terminals is reduced by commonly inputting the recording data of a plurality of blocks and drive pulse width signals from the recording apparatus main unit into the recording head.

Further, as a method for utilizing a plurality of input pulses as a large variety of pulses, U.S. Pat. No. 6,116,714 discusses a method for selecting a plurality of input pulses to form a plurality of heat pulses.

Further, since the number of recording elements is increasing due to the increased precision and improved image quality, the block division number in the above-described time-division driving is tending to increase. If the block period is fixed, the drive period will become longer due to the increase of the block division number.

In the future, there will be further a need for improvements in speed. Therefore, especially in recording apparatuses, along with the increase in the number of recording elements, the transfer of increasing amounts of recording information at high speed via a small number of terminals will be an important challenge.

FIG. 5 of U.S. Pat. No. 7,029,084 illustrates a data low-voltage differential signaling (LVDS) transmission line of a clock and data wired from a recording apparatus to a drive circuit in a recording head. More specifically, in this configuration, a serial data stream and a clock corresponding thereto are received by the LVDS line. LVDS technology is effective for high-speed transfer and also as a measure against noise, and is thus effective in a recording head.

U.S. Pat. No. 6,830,301 discusses a following data transfer method. As illustrated in FIG. 18, a plurality of blocks of recording data and block control data (DATA), and a drive pulse width signal (ENB signal, corresponding to HEAT) are serially transferred to the gate array of a carriage using a common signal line. As a result, the block period becomes longer and the problem of a longer drive period appears. In such a configuration, how to deal with the increase in speed which will be demanded even more in the future becomes a challenge.

SUMMARY OF THE INVENTION

The present invention is directed to a head element substrate which can receive recording data and a drive pulse width signal which are transferred from a recording apparatus using common signal lines and terminals to shorten the data receiving period compared with the conventional one.

Further, the present invention is directed to a recording apparatus which can shorten the data transfer period compared with the conventional one and can multiplex recording data and a drive pulse width signal.

According to an aspect of the present invention, a head element substrate includes a plurality of recording elements, the head element substrate including receiving means for receiving data in which bits of drive pulse width data are interposed between bits of recording data, separation means for separating the recording data from the data received by the receiving means, and signal generation means for generating a drive pulse width signal which defines a power-on period of the plurality of recording elements by separating the drive pulse width data from the data received by the receiving means, wherein the plurality of recording elements are driven based on the recording data separated by the separation means and the drive pulse width signal generated by the signal generation means.

According to the embodiments of the present invention, a head element substrate receives data, which has bits of drive pulse width data interposed between bits of recording data. The recording data and drive pulse width data are separated from the received data in the head element substrate, and the recording elements are driven by generating a drive pulse width signal.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

The embodiments of the present invention will now be described in more detail with reference to the attached drawings. In the present specification, "on the element substrate" not only refers to simply on the element substrate, but also refers to the surface of element substrate and the interior side of the element substrate near the surface. Further, "built into" not only refers to merely respectively separate elements being arranged on the element substrate, but also to integrally forming and producing the respective elements on the element substrate by a semiconductor circuit fabrication step or the like.

First Exemplary Embodiment

Figure 14:
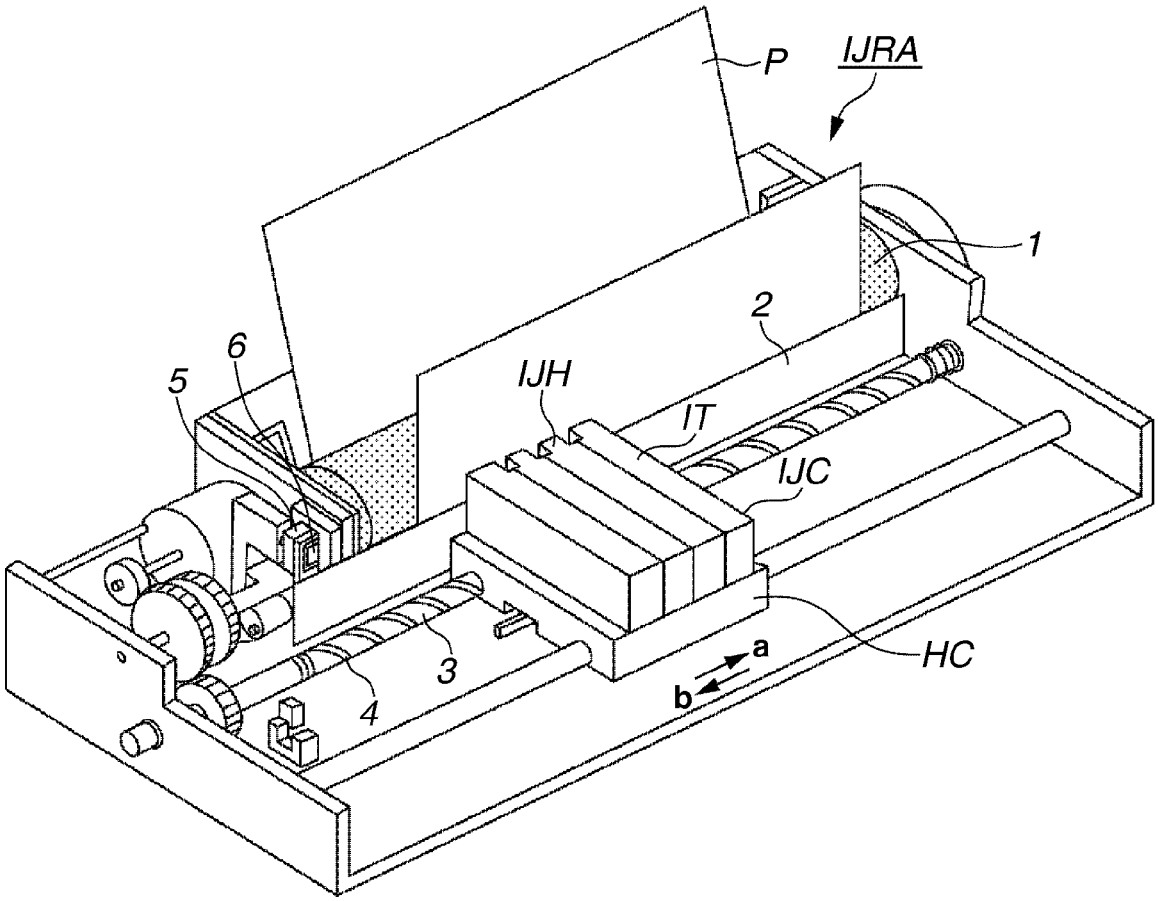
FIG. 14 is an explanatory diagram illustrating one example of a recording apparatus to which the present invention can be applied.

FIG. 14 is a perspective view of an inkjet recording apparatus to which the present invention can be applied. In FIG. 14, a carriage HC has a pin (not-illustrated) which engages with a spiral groove 4 of a lead screw 3, so that the carriage HC is moved back and forth in the direction of arrows a and b with the rotation of the lead screw 3. An inkjet cartridge IJC is mounted on this carriage HC. The inkjet cartridge IJC includes an inkjet head (hereinafter, "recording head IJH") and an ink tank IT which stores ink for recording. A head element substrate 100 is mounted on the recording head IJH. The head element substrate is electrically connected with a recording apparatus IJRA via the recording head.

A paper pressing plate 2 presses a sheet of paper against a platen 1 along the movement direction of the carriage. The platen 1 is rotated by a conveyance motor (not illustrated) to convey the recording paper P. A member 5 supports a cap member 6 which caps the front face of the recording head.

Figure 15:
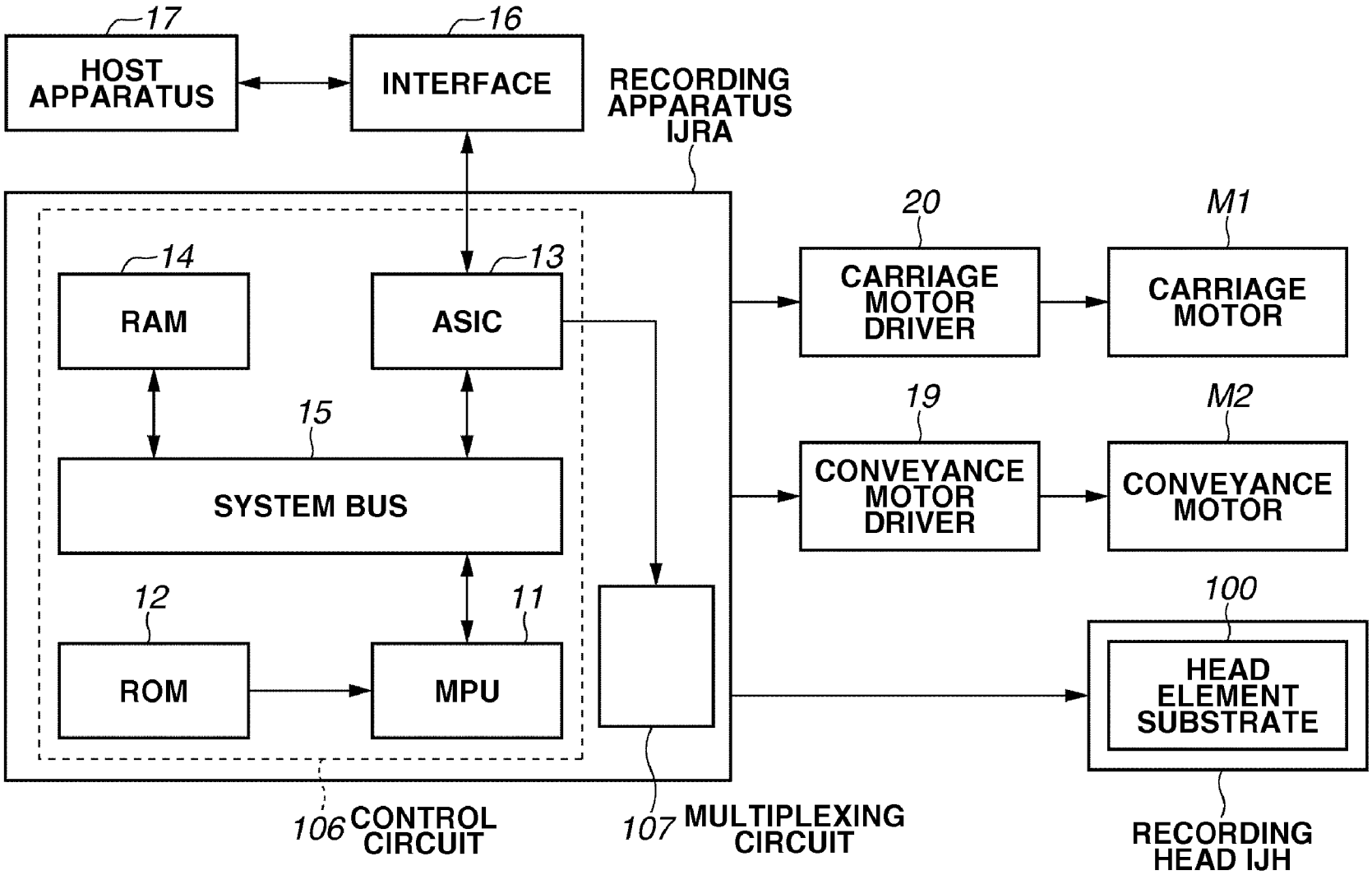
FIG. 15 is a block diagram illustrating the configuration of a control circuit of a recording apparatus.

FIG. 15 is a block diagram illustrating the control configuration of the recording apparatus IJRA shown in FIG. 14.

As illustrated in FIG. 15, a control circuit 106 is configured from the following features: an MPU 11; a ROM 12 in which a program corresponding to a control sequence, required tables, and other fixed data are stored; an application specific integrated circuit (ASIC) 13 which generates control signals for a carriage motor M1 control, a conveyance motor M2 control and recording head IJH control; a RAM 14 provided with a recording data rasterization region, a work region for program execution and the like; and a system bus 15 which interconnects the MPU 11, the ASIC 13, and the RAM 14 and exchanges data among them.

Further, in FIG. 15, recording data, commands, status signals and the like are sent and received between a generically-termed host apparatus 17, which is a computer (or, a reader for image reading or a digital camera etc.) serving as the supply source of the recording data, and the recording apparatus IJRA via an interface (I/F) 16.

Further, a carriage motor driver 20 drives a carriage motor M1 for scanning the carriage HC back and forth in the direction of the arrows a and b and a conveyance motor driver 19 drives a conveyance motor M2 for conveying the recording medium P.

The ASIC 13 supplies the logic signals which need to be sent to the recording head while directly accessing the recording region of the RAM 14 during the scanning and recording by the recording head IJH. These logic signals include recording data, block control data, a clock and a drive pulse width signal. These signals are supplied to a multiplexing circuit 107. The data multiplexed by the multiplexing circuit 107 is supplied to a recording head mounted with a head element substrate.

Next, among the control features illustrated in FIG. 15, the configuration of the head element substrate 100 and the configuration of the multiplexing circuit 107 in the recording apparatus IJRA will be briefly described with reference to FIG. 1.

Figure 1:
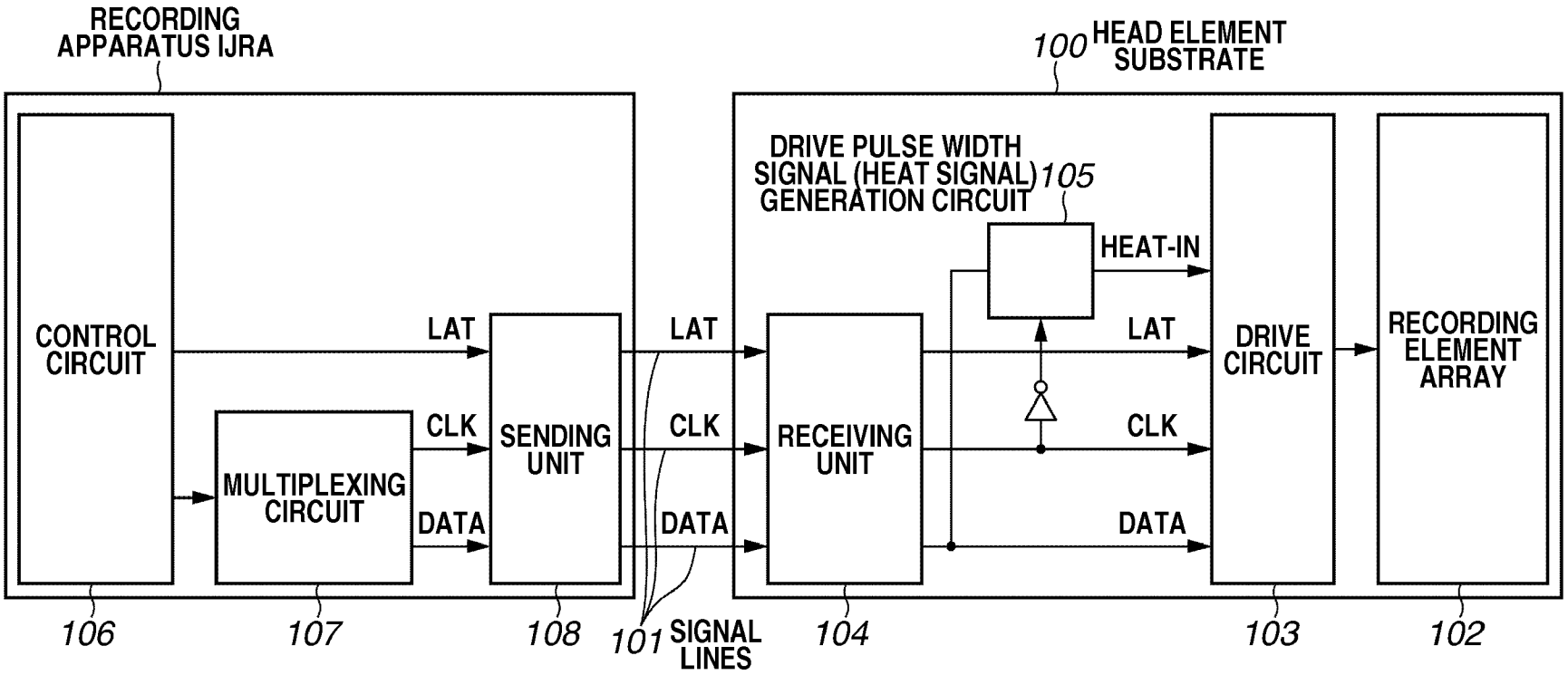
FIG. 1 is a block diagram illustrating the connection configuration between a recording apparatus and a head element substrate to which the present invention can be applied.

FIG. 1 is a block diagram illustrating the connection between a recording apparatus to which the present invention can be applied and a head element substrate. Three signal lines 101 for sending data (DATA), a clock (CLK), and a latch signal (LAT) are provided from the recording apparatus IJRA to the head element substrate 100. Data (DATA) with an interposing drive pulse in which recording data and block control data have been serially combined by the multiplexing circuit in the recording apparatus is transferred to the head element substrate 100 using a data terminal. Therefore, signal lines and heat signal terminals which have conventionally been used for transferring the drive pulse width signal (HEAT) to the head element substrate 100 are not necessary. Here, "drive pulse width data" is a signal in which the analog signal (i.e., "drive pulse width signal (HEAT)") is digitized at the frequency resolution of a trigger signal (TRG) in the below-described multiplexing circuit.

In order to reduce the number of terminals, as discussed in U.S. Pat. No. 6,830,301, block control data is known which can be additionally serially combined to recording data so that data is transferred via a single terminal. While this configuration is also employed in the present invention, whether the block control data is serially combined to recording data is not essential from the perspective of multiplexing the data. Therefore, for the sake of simplicity, a description about multiplexing and separating the block control data and the drive pulse width data will be omitted below.

The recording apparatus IJRA of FIG. 1 includes a control circuit 106, a multiplexing circuit 107, and a sending unit 108. Recording data and a drive pulse width signal are sent from the control circuit 106 to the multiplexing circuit 107. Multiplexed data (DATA) produced from the recording data and drive pulse width signal is generated by the multiplexing circuit 107. A clock (CLK), a latch signal (LAT), and the multiplexed data (DATA) are sent from the sending unit 108 included in the recording apparatus IJRA to the head element substrate 100.

Figure 16:
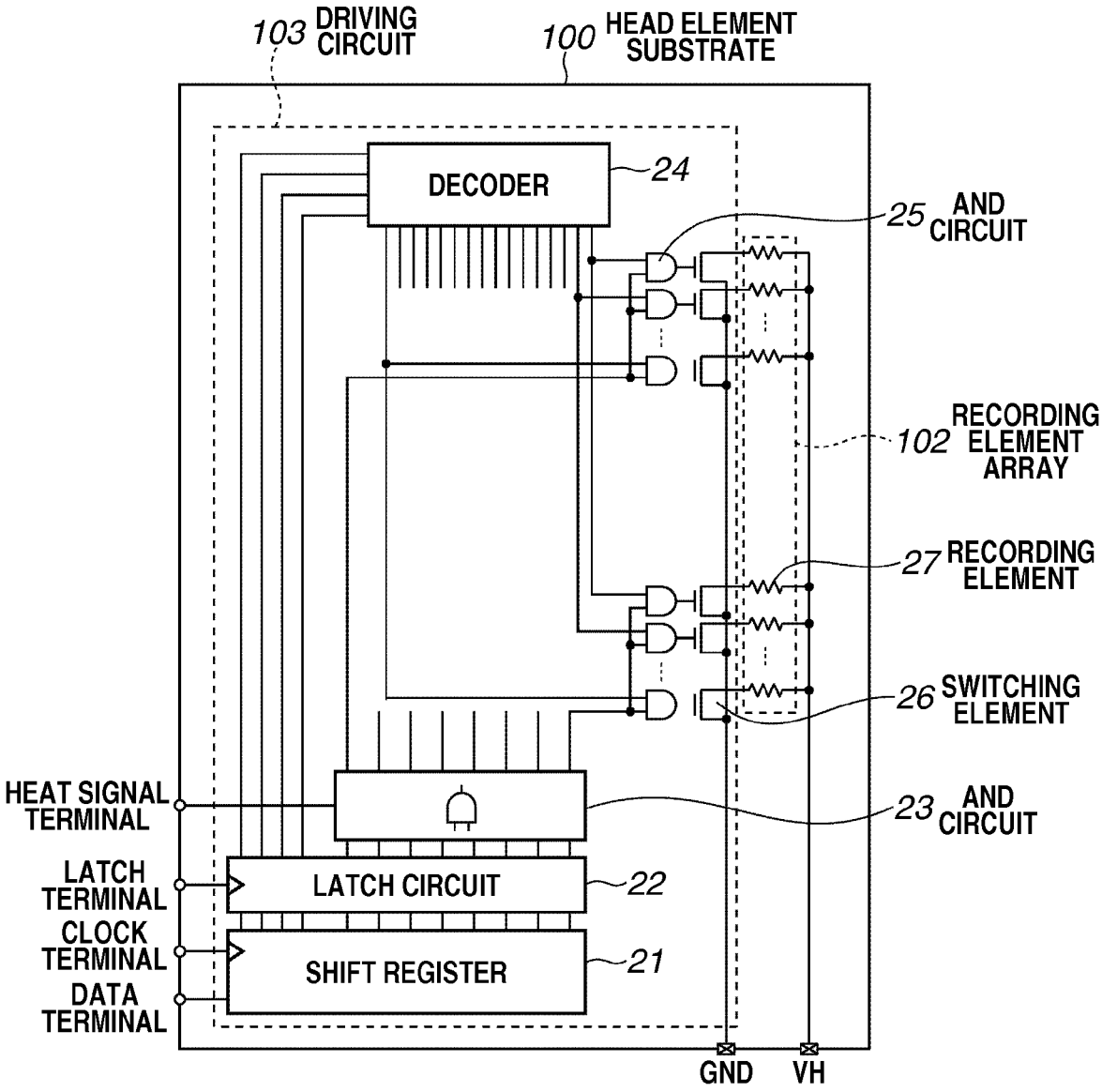
FIG.16 PRIOR ART
FIG. 16 is an equivalent circuit diagram representing the circuit configuration of a conventional head element substrate.
Figure 17:
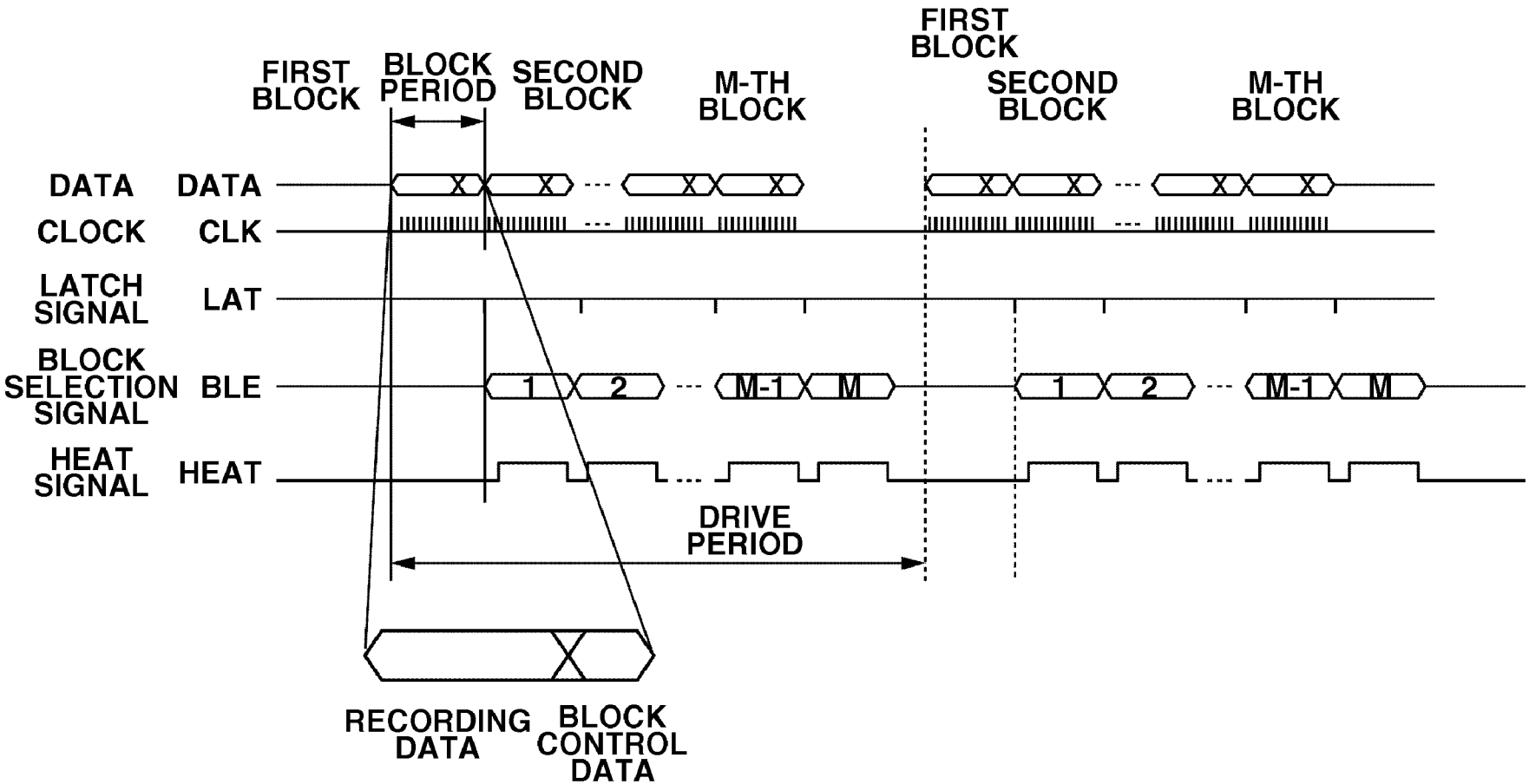
FIG.17 PRIOR ART
FIG. 17 is a drive timing chart illustrating the communication state in the drive circuit of a conventional head element substrate.
Figure 18:
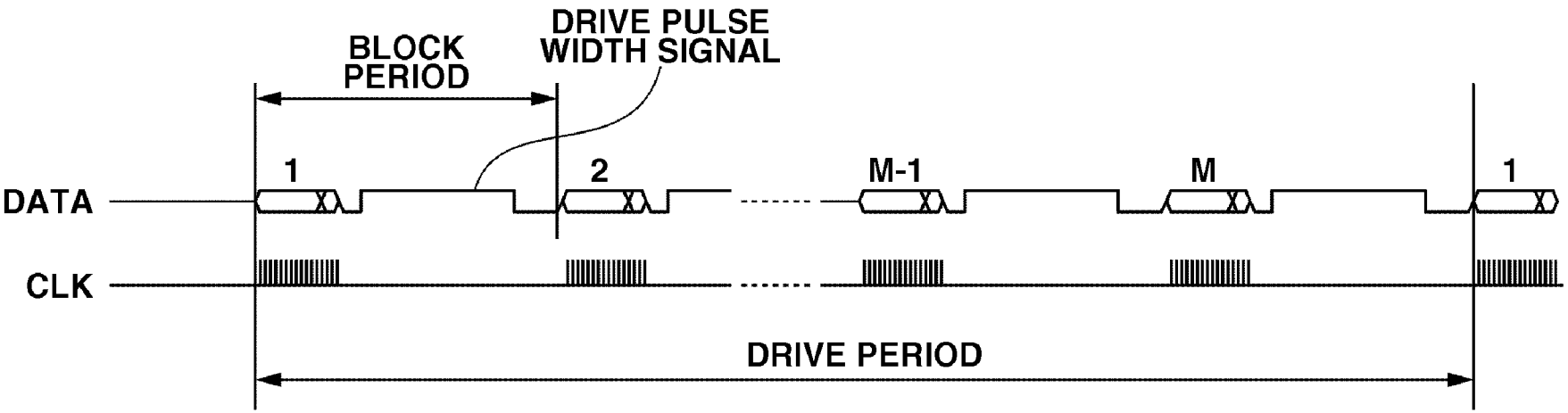
FIG.18 PRIOR ART
FIG. 18 is timing chart for describing the case where recording data and a drive pulse width signal are serially transferred as in the conventional art.

The head element substrate 100 of FIG. 1 includes a recording element array 102 configured from recording elements (e.g., an electrothermal transducer), and a drive circuit 103. The head element substrate 100 also includes a receiving unit 104 configured by a buffer circuit for receiving logic signals, and a drive pulse width signal generation circuit 105. A description of the drive circuit 103 in FIG. 1 will be omitted, as the drive circuit 103 has the same configuration as the drive circuit described for FIG. 16.

Figure 2:
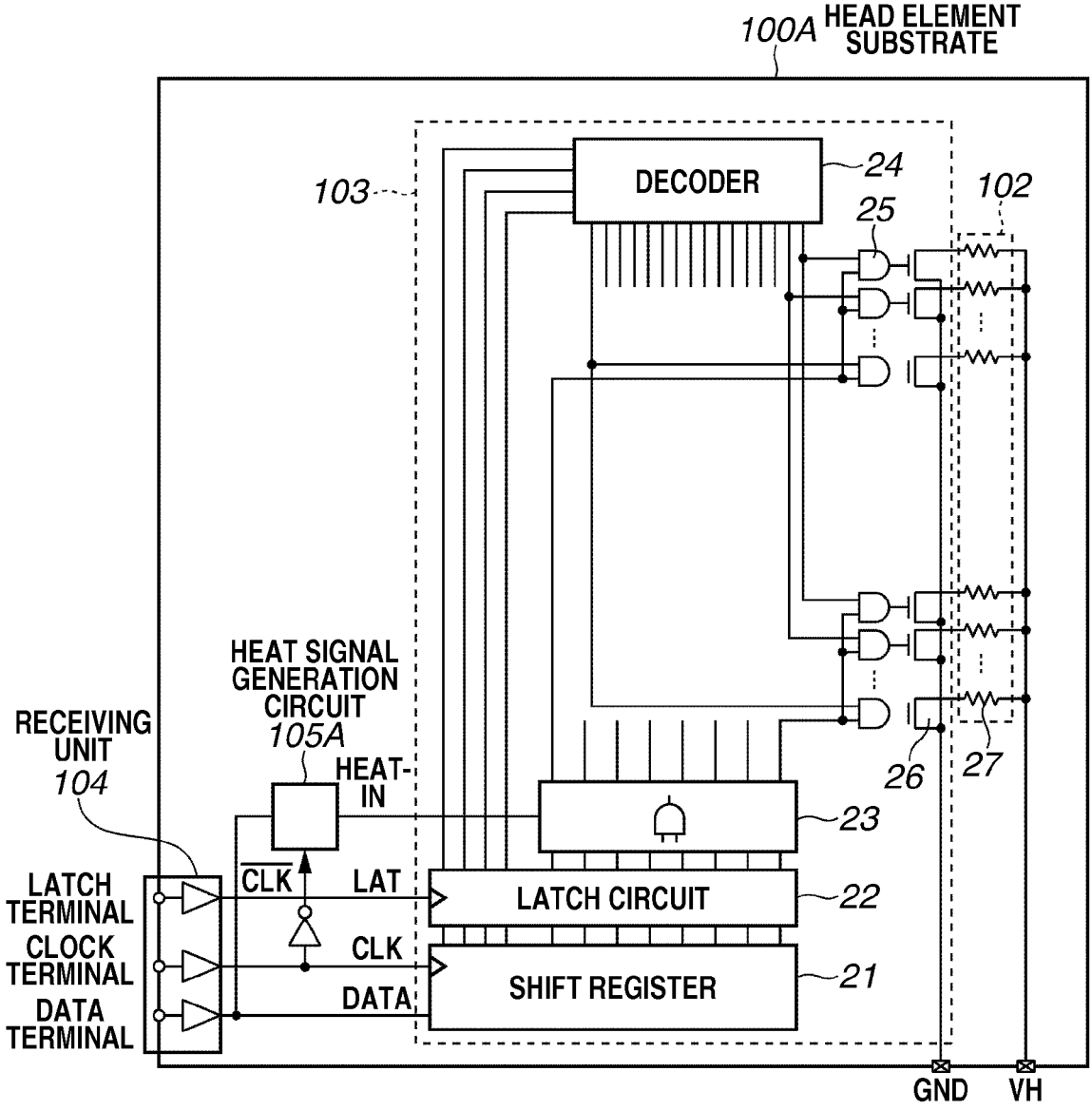
FIG. 2 is an equivalent circuit diagram representing the circuit configuration of the head element substrate according to the first exemplary embodiment of the present invention.

The flow of the signals in the head element substrate will now be briefly described using FIG. 2.

FIG. 2 is an equivalent circuit diagram of a circuit provided on a head element substrate 100A according to the first exemplary embodiment. The drive circuit 103 is driven by data (DATA), a latch signal (LAT), a clock (CLK), and a heat signal generated in the head substrate. In the present specification, a heat signal which is generated in the head substrate is referred to as (HEAT-IN).

Figure 3:
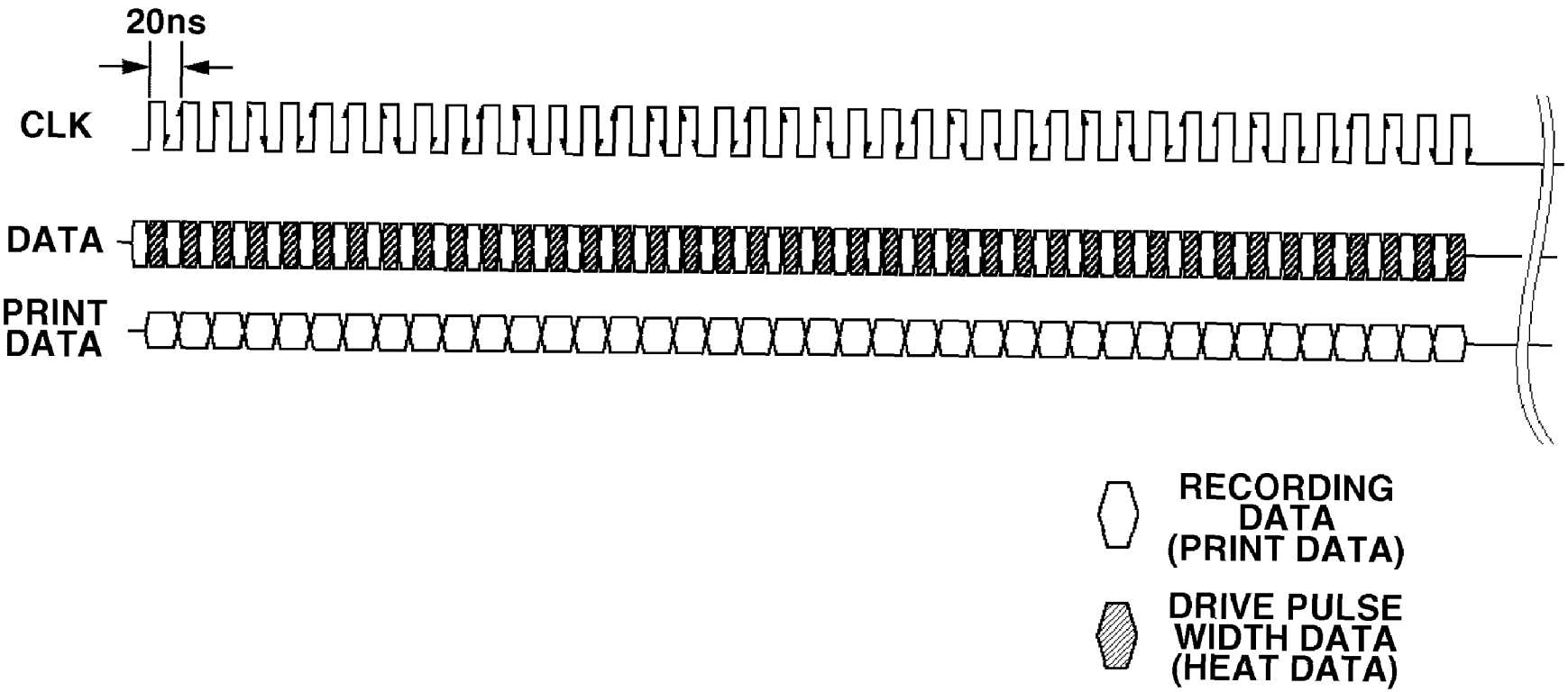
FIG. 3 is a timing chart concerning recording data illustrating the communication state in the block diagram of FIG. 2 according to the first exemplary embodiment of the present invention.

A case in which the multiplexed data is sent externally from the head element substrate (recording apparatus) as illustrated in FIG. 3 will now be described. In this case, each piece of data is periodically arrayed per recording data bit and per drive pulse width data (hereinafter, "heat data") bit. If data is configured in such a manner, sampling of the data (DATA) can be performed by synchronizing one of the data with the leading edge of the clock, and synchronizing another data with the trailing edge of the clock.

The flow in which the recording data is separated in the head element substrate will now be described using FIGS. 2 and 3.

As illustrated in FIG. 3, among the multiplexed data (DATA), the recording data is synchronized with the leading edge of the clock. As described as to the equivalent circuit diagram of FIG. 2, the multiplexed data (DATA) and the clock (CLK) synchronizing with the array period of the recording data bits are input into a shift register 21. In the shift register, among the multiplexed data, only the bits corresponding to the recording data are shifted by the clock. As a result, in the shift register, only the recording data (PRINT DATA) is separated and held as illustrated in FIG. 3. The subsequent signal flow is the same as what was described with reference to FIG. 16. Thus, in the circuit configuration of the present embodiment, the recording data can be separated from the multiplexed data using the shift register 21 as the separation means.

The flow of separating the drive pulse width data (heat data) in the head element substrate and generating the drive pulse width signal (heat signal) will now be described using FIGS. 2, 4A, 4B, 5A, and 5B.

An example of the drive pulse width signal (heat signal) generation circuit 105 on the head element substrate illustrated in FIG. 2 will now be specifically described.

Figure 4A:
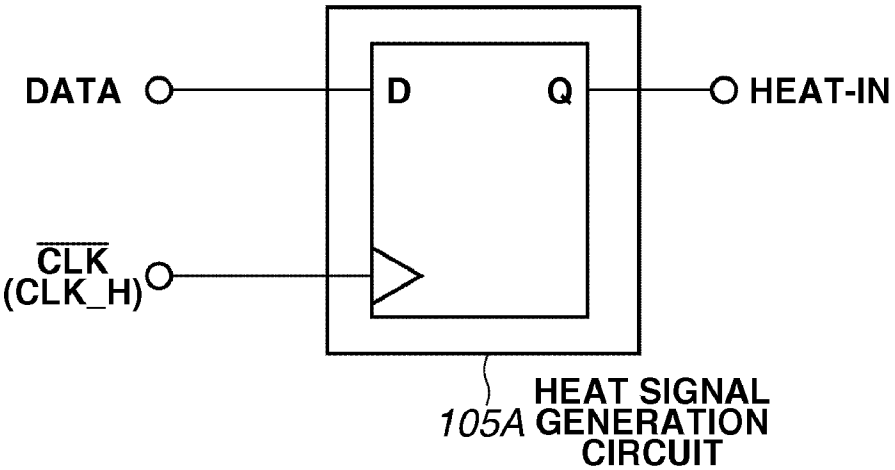
FIGS. 4A and 4B are timing charts concerning a configuration example of the drive pulse width signal (heat signal) generation circuit and heat signal according to the first exemplary embodiment of the present invention.

A heat signal generation circuit 105A configured by a D flip-flop circuit is illustrated in FIG. 4A. Multiplexed data (DATA) and an inverse clock are input into the heat signal generation circuit 105A.

Figure 4B:
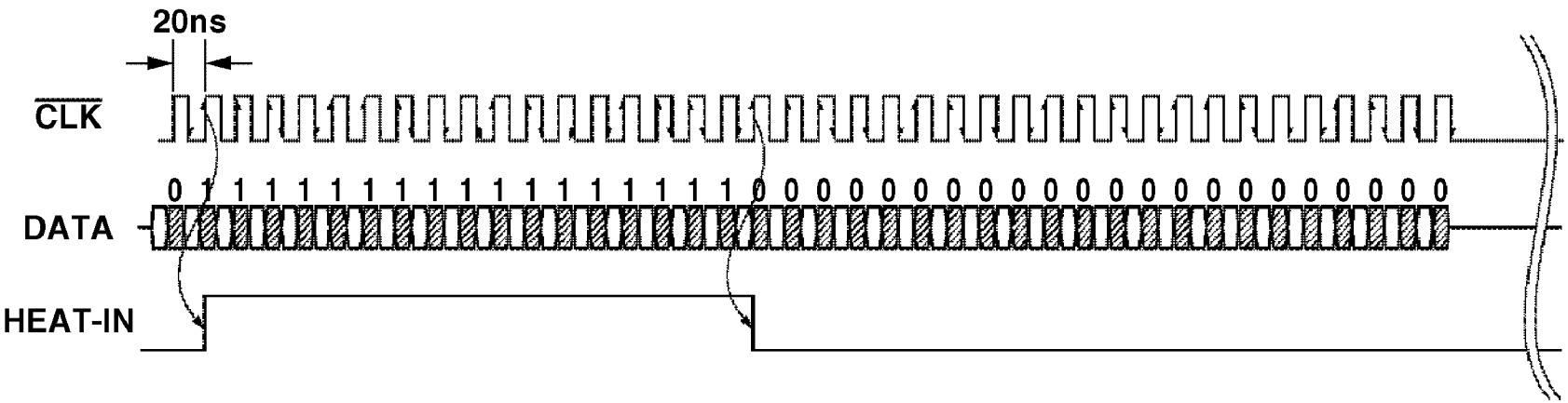

As illustrated in FIG. 4B, during the period in which one bit data has a logical value "1" in which the multiplexed data (DATA) is sampled by the inverse clock, the D flip-flop output Q, which is the heat signal (HEAT-IN), is active. In this configuration, an arbitrary heat signal (HEAT-IN) can be generated from the multiplexed data.

Figure 5A:
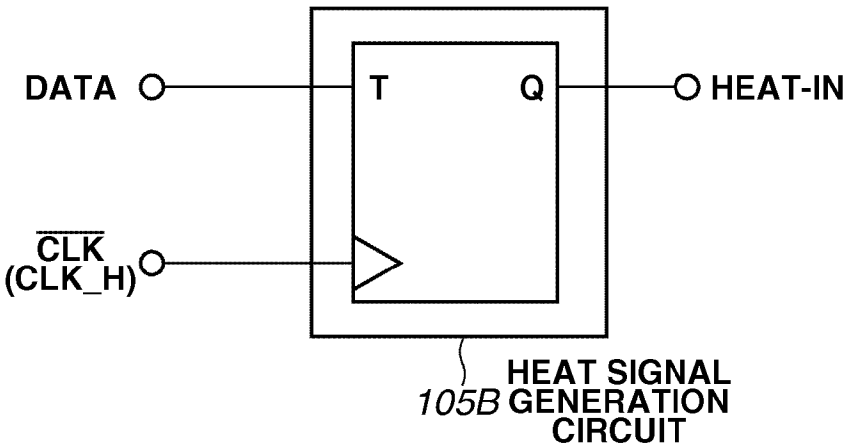
FIGS. 5A and 5B are timing charts concerning another configuration example of the drive pulse width signal (heat signal) generation circuit and heat signal according to the first exemplary embodiment of the present invention.

As another example, a heat signal generation circuit 105B configured by a T flip-flop circuit is illustrated in FIG. 5A.

Figure 5B:
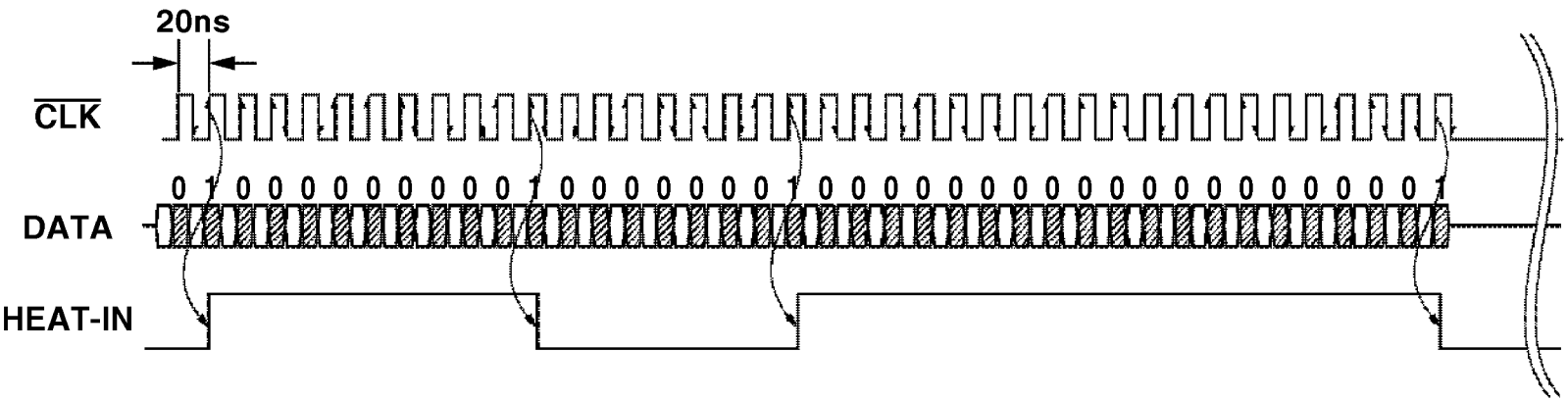

When one bit of data has a logical value "1" in which the multiplexed data (DATA) is sampled by the inverse clock, the active period of the T flip-flop output Q, which is the heat signal (HEAT-IN), starts. This state is illustrated in FIG. 5B. The active period is held until next the logical value of the sampled one bit of data becomes "1". In this configuration, an arbitrary heat signal (HEAT-IN) can be generated from the multiplexed data. Conventionally, it has been known to perform control of the discharge characteristics in a more complex manner by powering on the recording element over a plurality of periods. When such control is desired, by configuring the heat data as illustrated in FIG. 5B, a heat signal having a plurality of active periods can be generated.

Thus, based on the multiplexed data (DATA) and the clock (CLK), the heat data is separated by a heat signal generation circuit in the head substrate as the separation means, so that a heat signal (HEAT-IN) can be generated.

As described above, the drive circuit 103 can be driven by recording data separated by the circuit on the head element substrate, and by a separated and generated heat signal (HEAT-IN) and latch (LAT).

Figure 6:
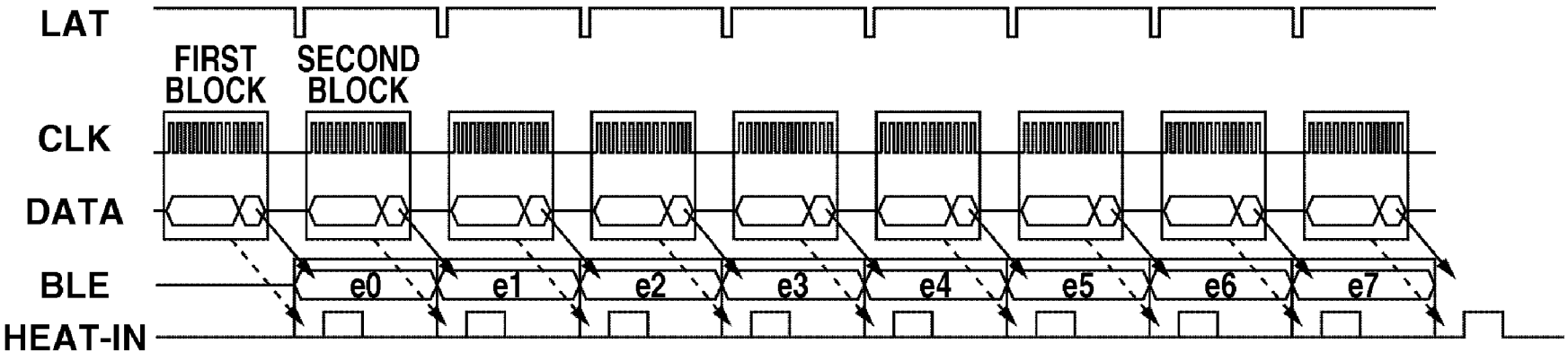
FIG. 6 is a drive timing chart illustrating the communication state in the drive circuit of the head element substrate according to the first exemplary embodiment of the present invention.

Next, the operation of the drive circuit will be described in more detail using FIGS. 2 and 6. FIG. 6 is a timing chart for describing the timing of the respective signals. Latch (LAT), clock (CLK), and data (DATA) are signals input from the data terminal, clock terminal, and latch terminal of the head element substrate 100A illustrated in FIG. 2. The first block of data (DATA) is input along with the clock (CLK) into the shift register 21 of FIG. 2 so that the recording data and the block control data are held as described above. After input of the first block of data (DATA) is finished, the recording data and the block control data held in the shift register 21 are latched into a latch circuit 22 according to the latch signal (LAT). The block control data output from the latch circuit 22 is input into a decoder 24, and a block selection signal for selecting the block of the recording element to be driven is output from the decoder. On the other hand, for the next second block or later, the data (DATA) in which the heat signal is multiplexed is transferred. While the second block of data (DATA) is transferred and input into the shift register 21, data (DATA) and an inverse clock are input also into the heat signal generation circuit 105A, whereby a heat signal (HEAT-IN) is generated. The logical product of the heat signal (HEAT-IN) derived from this second block and the recording data derived from the output first block which is held in the latch circuit is calculated by an AND circuit 23. The logical product of an output signal from the AND circuit 23 and a block selection signal derived from the first block coming from the decoder 24 is calculated by an AND circuit 25. Based on that output signal, a switching element 26 is driven and a recording element 27 is driven. A recording operation is performed by repeating these steps.

In the present embodiment, data (DATA) is transferred per block. The recording data and block control data separated in the head element substrate are transferred, and the heat signal is transferred in the next block in which the recording data and block control data are transferred.

A method for generating the data which is sent to the head element substrate described in the first embodiment includes the following parallel-serial conversion method. Recording data and a heat signal are input in parallel from the control circuit 106 in the recording apparatus IJRA in FIG. 1 into the multiplexing circuit 107, and multiplexed serial data is output from the multiplexing circuit 107. An example of the multiplexing circuit 107 will now be described in detail using FIG. 7.

Second Exemplary Embodiment

In the second embodiment, an example of a multiplexing circuit which generates data in which one bit of recording data and one bit of heat data are periodically arrayed, as illustrated in FIG. 3 of the first embodiment, is described.

Figure 7A:
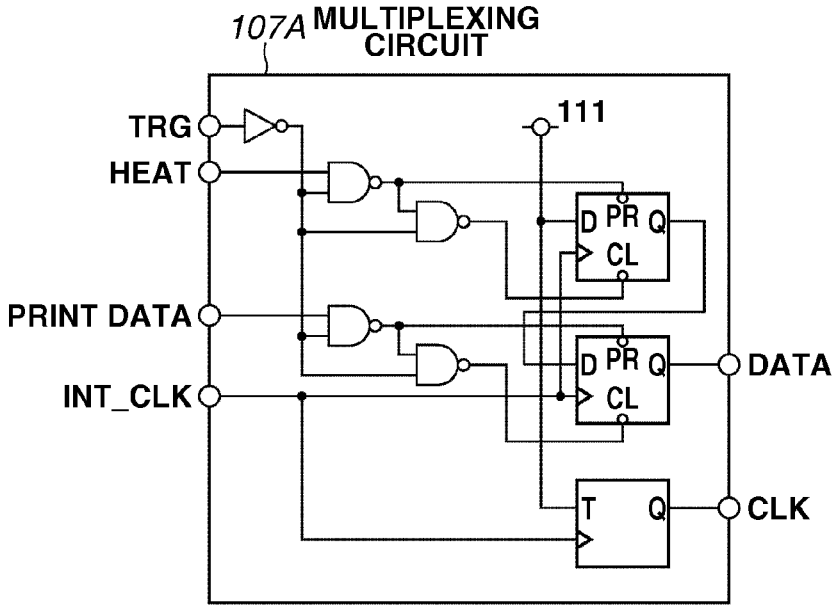
FIGS. 7A and 7B are diagrams for describing the multiplexing circuit according to the second exemplary embodiment of the present invention.
Figure 7B:
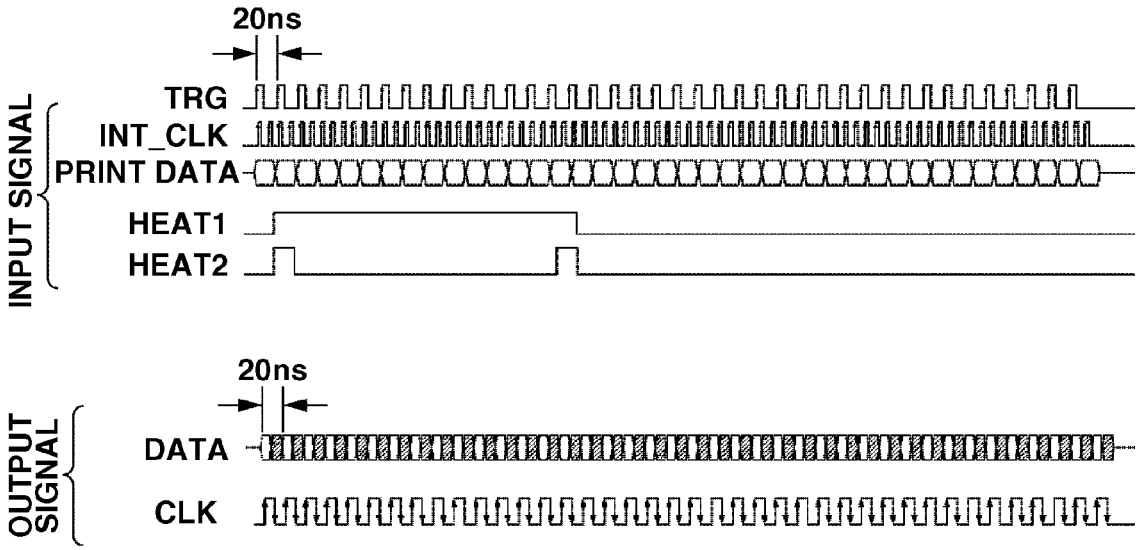

Into the multiplexing circuit 107A illustrated in FIG. 7A, the following signals are input as input signals from the control circuit 106 as illustrated in FIG. 7B: a trigger signal (TRG); recording data (PRINT DATA); a heat signal (HEAT 1 or HEAT 2), which is an analog signal; and an internal clock (INT_CLK). In FIG. 7A, reference numeral 111 is a pull-up terminal.

The clock frequency of the internal clock (INT_CLK) used within the multiplexing circuit 107A may be set so that it has a sufficient pulse width adjustment resolution to control the heat signal (HEAT).

The recording data (PRINT DATA) generated based on the recorded image by the control circuit 106 is sent into the multiplexing circuit 107A along with a trigger signal (TRG) which has been synchronized to the internal clock (INT_CLK). In the multiplexing circuit 107A, recording data (PRINT DATA) and a heat signal (HEAT) are preset in a flip-flop circuit at timing which synchronizes PRINT DATA and HEAT with the trigger signal (TRG). In this state, bits of the recording data (PRINT DATA) which has been synchronized to the internal clock (INT_CLK) and bits of the heat data (having active period information) in which the heat signal (HEAT) has been digitized are alternatingly arranged. As a result, the parallel-serial conversion is achieved. In this manner, the multiplexed data (DATA) and clock (CLK) synchronized thereto are output from the multiplexing circuit 107A.

In the configuration of the present embodiment, the recording data and the heat data are lined up alternatingly and multiplexed. Thus, if data is transferred at a frequency of 50 MHz for example, the active period (power-on time in the recording element) of the heat signal can be set at a 20 nanosecond resolution. Thus, the higher the frequency of the data transfer, the more precisely the energy applied to the recording element can be controlled.

Further, the details (data setting method) of the heat data may be arbitrarily changed according to the configuration of the drive pulse width signal (heat signal) generation circuit described in the first exemplary embodiment.

First, the case where the heat signal generation circuit is configured by a D flip-flop will be described. As the heat signal (HEAT) sent into the multiplexing circuit 107A, a signal like that of HEAT 1 in FIG. 7B will be described. The heat data is multiplexed with the recording data by the multiplexing circuit such that bits corresponding to an active period are a "1", and bits corresponding to inactive periods are a "0".

Next, the case where the heat signal generation circuit is configured by a T flip-flop will be described. In this case, the heat signal (HEAT) sent into the multiplexing circuit 107A is a signal like that of HEAT 2 in FIG. 7B. The heat data is multiplexed with the recording data by the multiplexing circuit 107A such that the bits corresponding to the start and the end of the active period are a "1", and the other bits are a "0".

Further, an arbitrary pulse is set so as to make a plurality of active periods in a one block period, so that the multiplexing of the data can be performed efficiently.

Thus, the recording apparatus in the present embodiment can generate the data by multiplexing the recording data and the heat data, in which a heat signal is digitized in the multiplexing circuit, and transfer the generated data via a common terminal.

Third Exemplary Embodiment

In the third embodiment, the present invention is applied to a recording head having a plurality of conventionally-known recording element arrays.

An example in which a head element substrate 100B has three recording element arrays 102 will now be described using FIG. 8.

Figure 8:
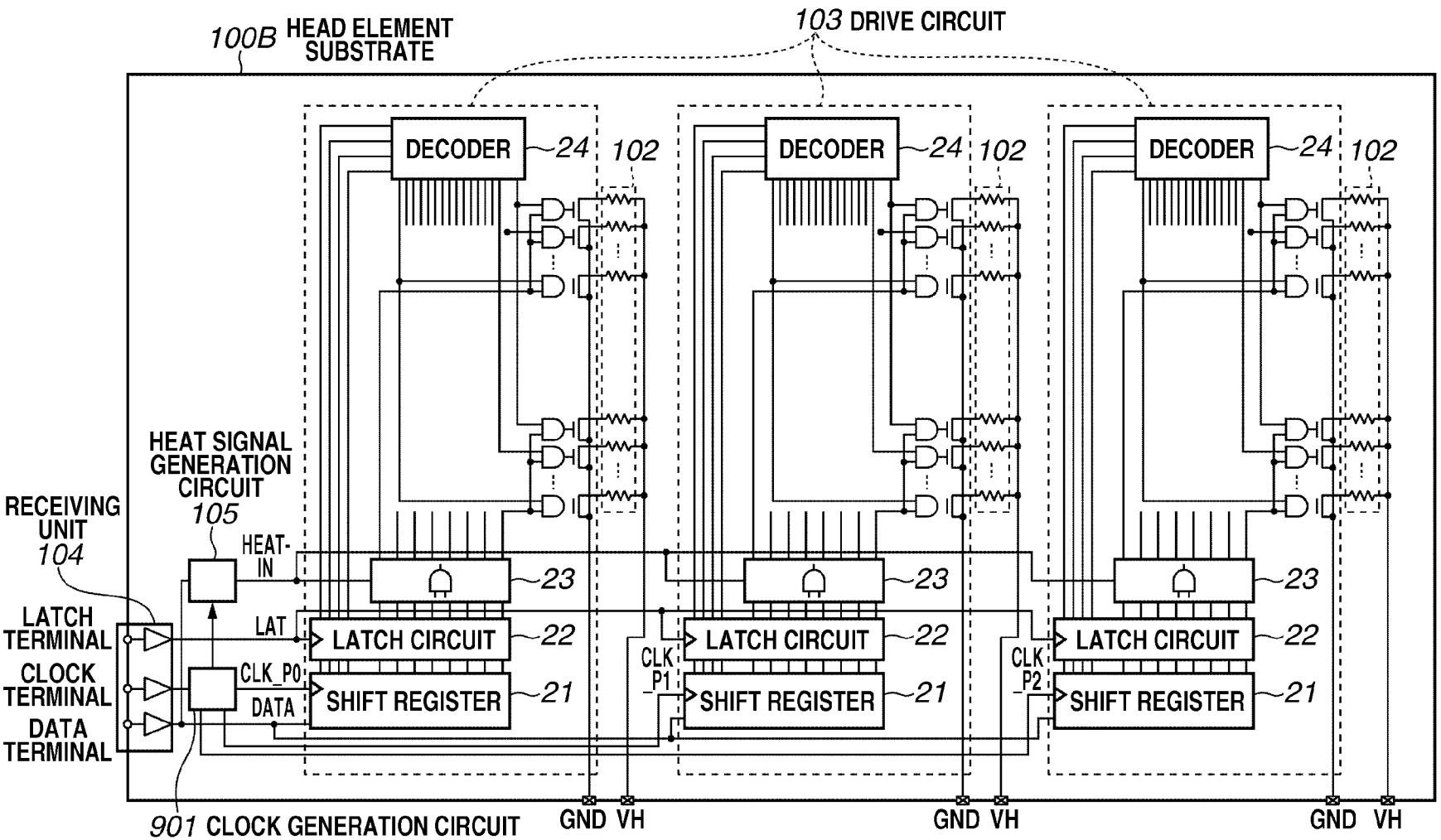
FIG. 8 is an equivalent circuit diagram representing the circuit configuration of the head element substrate according to the third exemplary embodiment of the present invention.

FIG. 8 is an equivalent circuit diagram of the head element substrate 100B. As illustrated in FIG. 8, DATA, HEAT-IN, and LAT signals are commonly input into a drive circuit 103 corresponding to respective recording element arrays 102. includes three of the recording element arrays 102 and drive circuits 103 of FIG. 2 according the first exemplary embodiment on a head element substrate. The head element substrate 100B has the same heat signal generation circuit as in the first embodiment. The difference with the head element substrate 100A of the first embodiment is that the substrate has a clock generation circuit. This clock generation circuit will now be described in more detail below.

Figure 9:
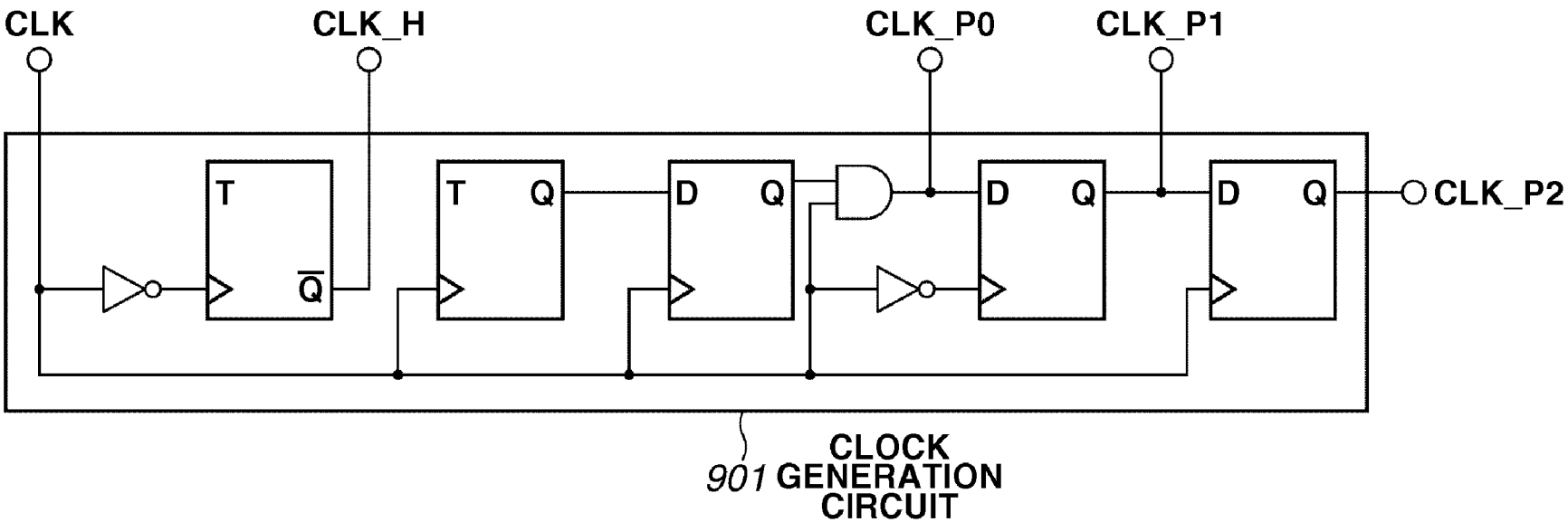
FIG. 9 is a diagram illustrating a configuration example of a clock generation circuit according to the third exemplary embodiment of the present invention.

The clock generation circuit 901 of FIG. 9 is illustrated as one example. In the clock generation circuit 901, the clock (CLK) is divided using a T flip-flop, a D flip-flop and the like. By dividing the clock in this manner, the CLK_P0, CLK_P1, CLK_P2, and CLK_H for sampling the data (DATA) can be generated. The T terminal of the T flip-flop in FIG. 9 is pull-up connected.

Figure 10A:
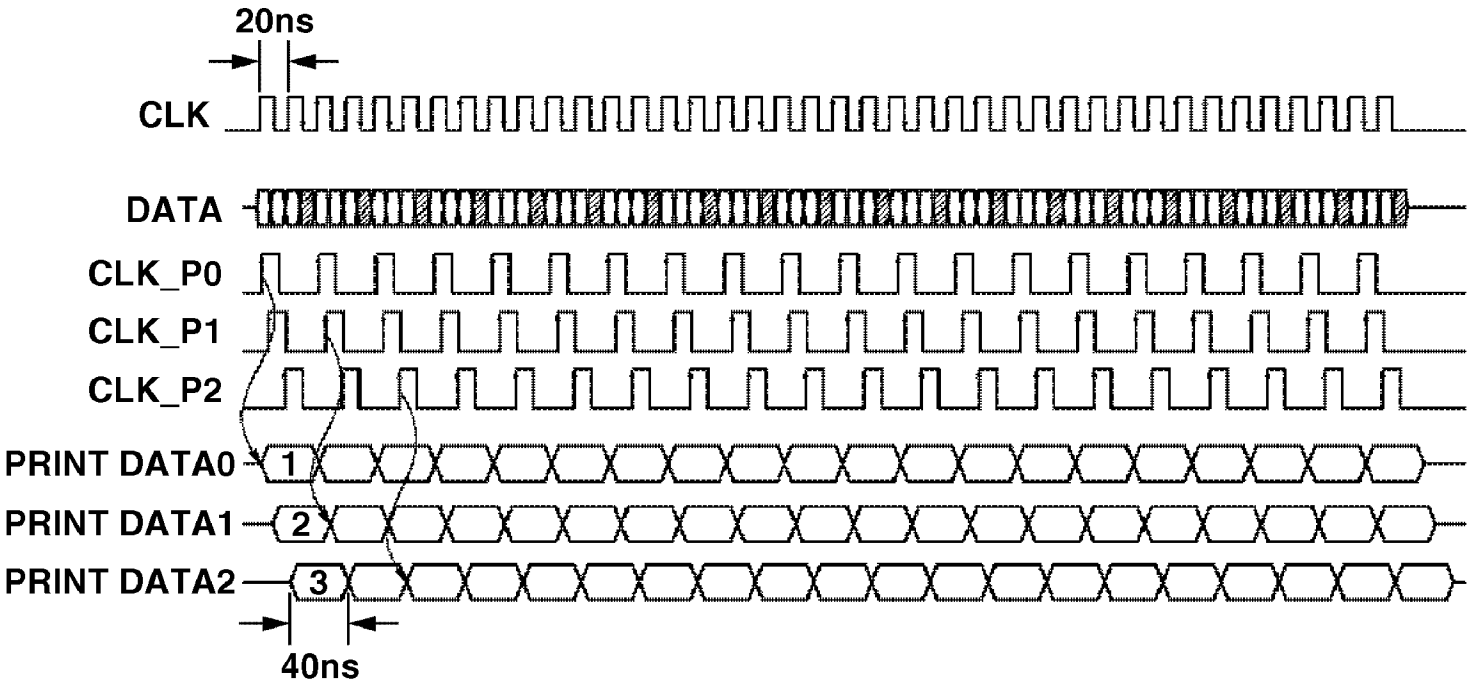
FIGS. 10A and 10B are drive timing charts illustrating the communication state in the drive circuit of the head element substrate according to the third exemplary embodiment of the present invention.

The flow for separating the recording data in the head element substrate will now be described using FIGS. 8 and 10A. First, referring to FIG. 10A, the CLK_P0 to CLK_P2 output from the clock generation circuit 901 are respectively synchronized with the array period of the bits of PRINT DATA0 to PRINT DATA2 among the multiplexed data (DATA). As illustrated in FIG. 8, the generated CLK_P0, CLK_P1, and CLK_P2, and the multiplexed data (DATA) are input into a shift register 21 in the drive circuit 103 corresponding to the respective recording element array 102.

In the shift register, among the multiplexed data, only the bits corresponding to the respective recording data PRINT DATA0 to PRINT DATA2 are shifted by the synchronizing CLK_P0 to CLK_P2. Thus, in each shift register, only the recording data PRINT DATA0 to PRINT DATA2 (FIG. 10A) is separated and held. The subsequent signal flow in each of the drive circuits 103 is the same as the first exemplary embodiment, and thus a description thereof will be omitted.

The flow for separating the drive pulse width data (heat data) in the head element substrate and generating the drive pulse width signal (heat signal), will now be described with reference to FIGS. 8 and 10B.

Figure 10B:
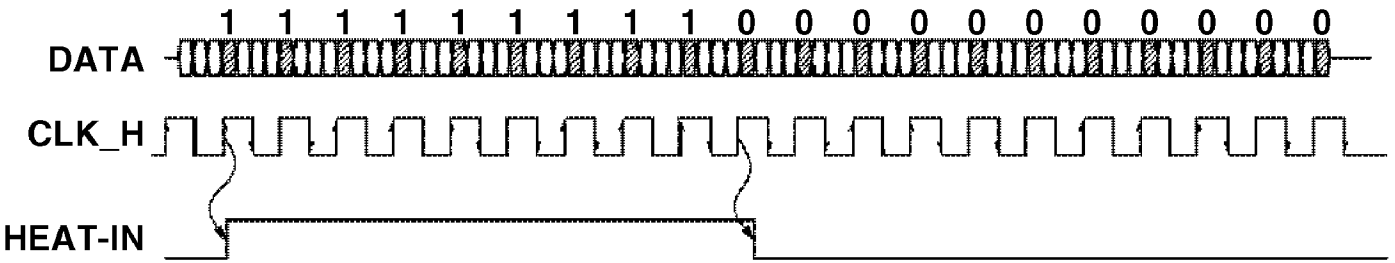

The CLK_H output from the clock generation circuit 901 is, as illustrated in FIG. 10B, synchronized with the array period of the heat data bits among the multiplexed data (DATA). As described in FIGS. 4A and 5A, the heat data synchronizing with the CLK_H is sampled from the data (DATA) multiplexed by the heat signal generation circuit 105. As a result, the heat signal (HEAT-IN) illustrated in FIG. 10B can be generated. As illustrated in FIG. 8, the generated heat signal (HEAT-IN) is commonly input into the AND circuit 23 of each drive circuit 103.

In the same manner as in the first embodiment, the heat signal (HEAT-IN) can be generated in the head element substrate by separating the heat data from the data (DATA) multiplexed by the heat signal generation circuit.

By employing the above configuration, a plurality of pieces of recording data corresponding to each recording element array 102 can be transferred via a single terminal, so that the number of terminals can be dramatically reduced. Examples of the plurality of pieces of recording data include recording data corresponding to three colors, such as cyan, magenta, and yellow, or recording data for nozzles having the different sizes of large, medium, and small.

Fourth Exemplary Embodiment

For the purpose of illustrating a method for generating the data which is sent to the head element substrate described in the third embodiment, a parallel-serial conversion circuit is described which is similar to the multiplexing circuit illustrated in the second embodiment.

In the fourth embodiment, an example of a multiplexing circuit will be specifically described with reference to FIGS. 11A and 11B. The multiplexing circuit generates data each piece of which is periodically arrayed per three bits of recording data and per one bit of heat data. Description of features which are the same as those described in FIGS. 7A and 7B will be omitted.

Figure 11A:
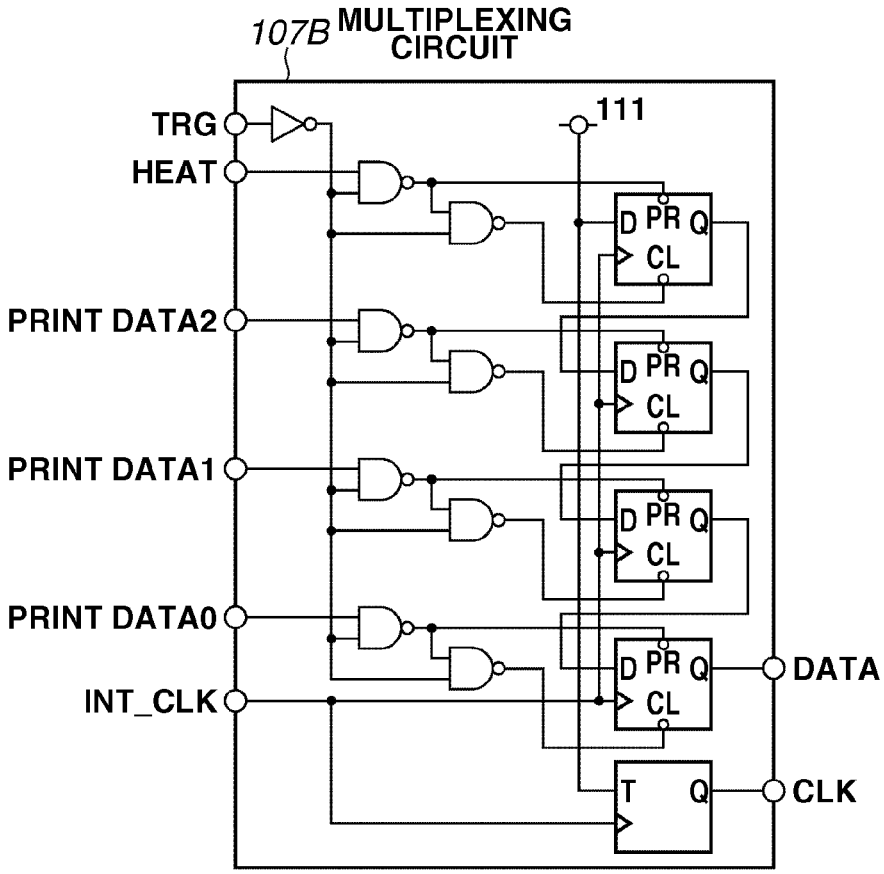
FIGS. 11A and 11B are diagrams for describing the multiplexing circuit according to the fourth exemplary embodiment of the present invention.
Figure 11B:
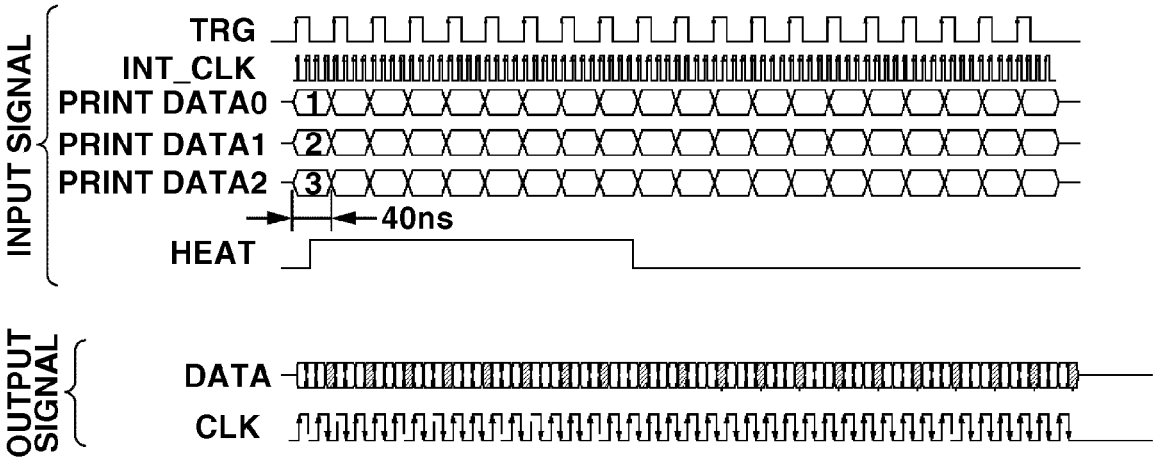

In the multiplexing circuit 107B illustrated in FIG. 11A, the following signals are input as input signals from the control circuit 106 as illustrated in FIG. 11B: a trigger signal (TRG); respective recording data (PRINT DATA0 to PRINT DATA2); a heat signal (HEAT), which is an analog signal; and an internal clock (INT_CLK).

As with the description of FIGS. 7A and 7B, the clock frequency of the internal clock (INT_CLK) used in the multiplexing circuit may be set so that it has a sufficient pulse width adjustment resolution to control the heat signal (HEAT).

The recording data (PRINT DATA0 to 2) generated on the basis of the recorded image by the control circuit 106 is sent into the multiplexing circuit 107B along with a trigger signal (TRG) which has been synchronized to the internal clock (INT_CLK). Within the multiplexing circuit, recording data (PRINT DATA0 to 2) and a heat signal (HEAT) are preset in a flip-flop circuit at timing which synchronizes them with the trigger signal (TRG). In this state, the recording data (PRINT DATA0 to 2) which has been synchronized to the internal clock (INT_CLK) and bits of the heat data (having active period information) in which the heat signal (HEAT) has been digitized are provided sequentially. In this manner, the parallel-serial conversion is achieved, and the multiplexed data (DATA) and clock (CLK) synchronized thereto are output from the multiplexing circuit 107B.

The heat data may be set in the same manner as in the second embodiment.

Thus, the recording apparatus in the present embodiment can generate data with a multiplexing circuit that multiplexes a plurality of pieces of recording data and heat data in which a heat signal is digitized and transfer the generated data via a common terminal.

Fifth Exemplary Embodiment

An example in which transfer carried out through a low-voltage differential signaling (LVDS) line is applied to the present invention will now be described. As illustrated in FIG. 1, instead of using one signal line (a single end signal line) per signal, a low-voltage differential signaling (LVDS) line using two signal lines per signal (1 system) is provided.

Figure 12:
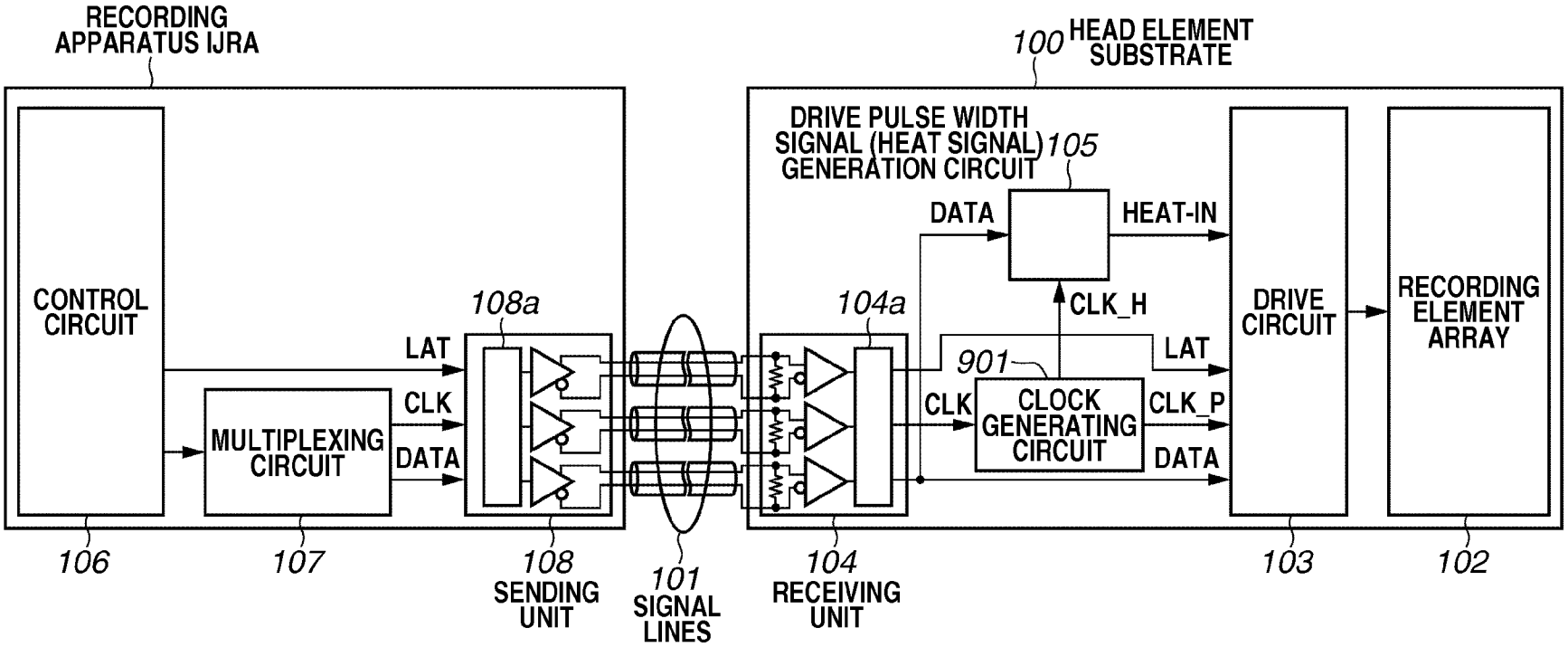
FIG. 12 is a block diagram illustrating the connection configuration between a recording apparatus according to the fifth exemplary embodiment which applies LVDS to the present invention and a head element substrate.

The head element substrate 100 illustrated in FIG. 12 is connected to a recording apparatus IJRA by a signal line 101 which is formed from a flexible cable or the like. The low-voltage differential input signal is about 100 mV. The recording apparatus IJRA includes a logic signal sending unit 108, and the head element substrate 100 includes a receiving unit 104. These sending and receiving units are a differential receiving unit or differential sending unit matching LVDS lines, so that the size of the buffer circuits (104*a* and 108*a*) can be reduced. Further, low-voltage signals suppress the power consumption on the circuit, and also contribute to dealing with electromagnetic interference (EMI). When the high frequency data has been input into the drive circuit, with a smaller configuration of the internal circuit of the drive circuit, functions appropriate to the high-frequency characteristics can be realized. The remaining portions are the same as the configuration of FIG. 1.

FIG. 12 illustrates an example in which LVDS is applied to the configurations described in FIGS. 1 and 8. The only differences with FIGS. 1 and 8 are the logic signal sending and receiving units.

Three low-voltage differential signaling (LVDS) line systems (6 lines) for transferring the multiplexed data (DATA), clock (CLK), and latch signal (LAT) are provided. These data can be broken down into data (DATA+ and DATA−), a clock signal (CLK+ and CLK−), and a latch signal (LAT+ and LAT−).

Compared with the configurations described in FIGS. 1 and 8, the number of terminals is doubled. However, recording data and a drive pulse width signal (heat signal) are multiplexed by a multiplexing circuit in the recording apparatus and transferred by one signal line. Further, the recording data and the drive pulse width signal (heat signal) are separated within the head element substrate.

Accordingly, the effects of multiplexing the recording data and the heat signal can be further achieved by transferring the data through the LVDS line which can transfer high-frequency signals. The block period can be especially shortened because the data transfer period can be shortened compared with the heat signal (HEAT) period, even if a large amount of data is transferred as described in the third embodiment. Further, because the signal is high-frequency, the active period (power-on time in the recording element) of the heat signal can be set at a higher resolution, and the energy applied to the recording element can be precisely controlled.

Although, like the configuration of FIG. 12, three low-voltage differential signaling (LVDS) line systems (6 lines) for transferring the data (DATA), clock (CLK), and latch signal (LAT) can be provided, compared with the configuration of FIG. 1, the number of terminals is doubled. Further, jitter (slight misalignment of the clock timing) on the sending side of the clock is more likely to occur at higher frequencies, which can render synchronization with high-frequency data impossible.

Sixth Exemplary Embodiment

Figure 13:
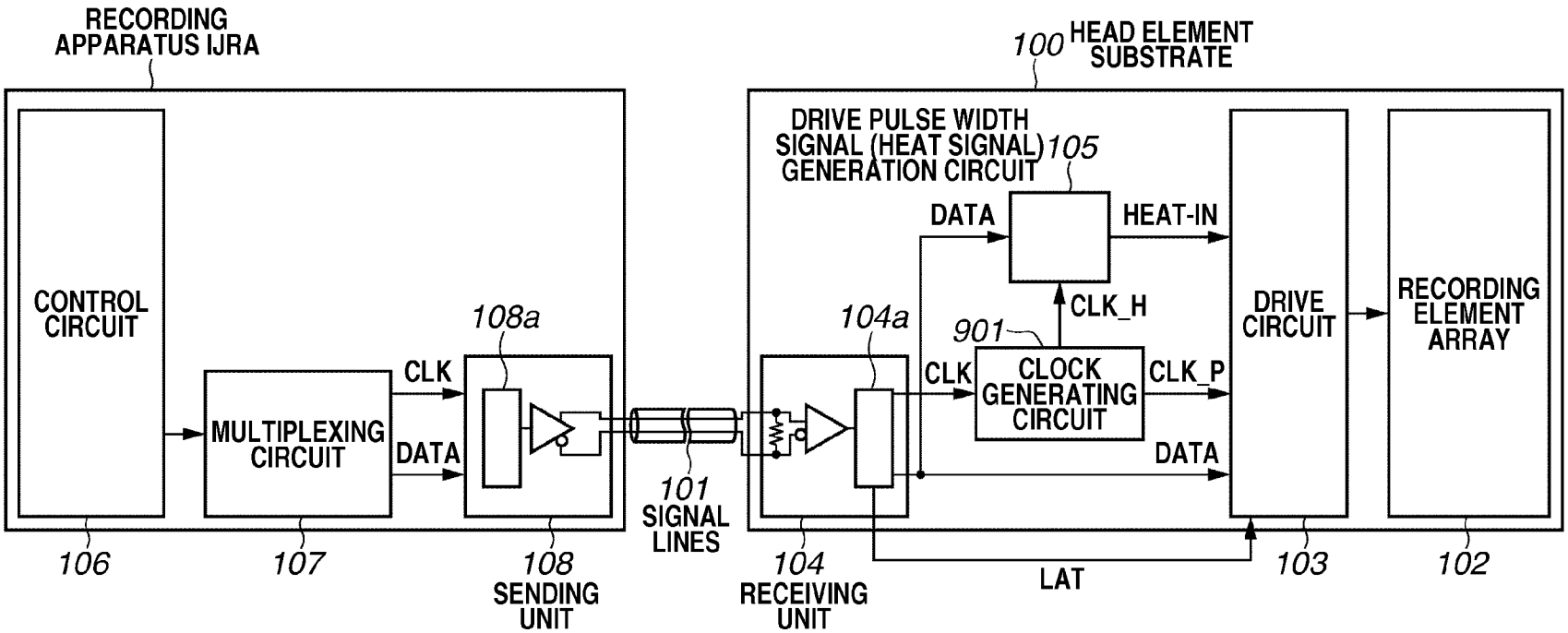
FIG. 13 is a block diagram illustrating the connection configuration between a recording apparatus according to the sixth exemplary embodiment which applies LVDS to the present invention and a head element substrate.

The configuration of a recording apparatus in which the recording data and a drive pulse width signal (heat signal) are multiplexed in the recording apparatus, and the other logic signals (clock, latch) are also multiplexed by the sending unit will now be described with reference to FIG. 13. By employing this configuration, data can be transferred by one LVDS line system (2 lines). Further, the configuration of a head element substrate which receives data transferred from a recording apparatus and can separate the multiplexed data in the head element substrate will now be described as an example.

Conventionally, the following technology has been known concerning LVDS. Using a PLL circuit and the like (included in 108*a* and 104*a*) provided in an LVDS transmitter 108 and a LVDS receiver 104, the data and clock are multiplexed in the LVDS transmitter 108, and the clock is reproduced from the data within the LVDS receiver 104. The latch signal (LAT) may be synchronized with the send timing of the data (DATA). Therefore, the reproduction of the data (DATA) and clock (CLK) and the generation of the latch (LAT) signal can be also performed within the head element substrate 100. By employing such a configuration, the number of terminals can be reduced even further.

The multiplexed data is input into the heat signal generation circuit 105 and the drive circuit 103 in the head element substrate. Then, information necessary for driving the recording element is extracted from the data (DATA) multiplexed by CLK_P and CLK_H that are obtained by the clock generation circuit 901. At this stage, the heat signal (HEAT-IN) can be generated by separating the heat data from the multiplexed data to separate the recording data (PRINT DATA) as illustrated in the timing chart of FIGS. 10A and 10B. With respect to each signal, the recording element can be arbitrarily driven according to the recording data by the drive circuit similar to conventional recording heads, as described in reference to FIG. 16.

Thus, the LVDS applied to the present invention is effective also as a measure against EMI, since the number of signal lines is low, the LVDS transfer system is resistant against common mode noise, and radiation noise is not easily emitted. "EMI" is electromagnetic interference or the radiation noise which may cause a malfunction of other nearby devices or elements due to generated radiation noise.

As above described in the exemplary embodiments of the present invention, recording data and a drive pulse width signal are not transferred as serial data as described in U.S. Pat. No. 6,830,301, but are transferred as multiplexed data. Therefore, recording data can be transferred while simultaneously transferring a drive pulse width signal. Further, a drive pulse width signal corresponding to recording data which has been transferred for a certain block may be multiplexed with the recording data of the next block, and transferred.

The configurations of the above-described embodiments can be applied to a configuration in which a plurality of head element substrates or a full line recording head which corresponds to the recording width are disposed. The signal transmission line according to the exemplary embodiments of the present invention was described with respect to a sending device and receiving device which are configured in one direction. However, the sending device and receiving device may also be configured to be bidirectional. As long as the effects of the present invention can be obtained, the present invention is feasible regardless of differences in electrical or mechanical configuration, or by differences in software sequence and the like.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2007-330950 filed Dec. 21, 2007, which is hereby incorporated by reference herein in its entirety.

What is claimed is:

1. A head element substrate including a plurality of recording elements, the head element substrate comprising:

receiving means for receiving data in which bits of drive pulse width data are interposed between bits of recording data;

separation means for separating the recording data from the data received by the receiving means; and signal generation means for generating a drive pulse width signal which defines a power-on period of the plurality of recording elements by separating the drive pulse width data from the data received by the receiving means, wherein the plurality of recording elements are driven based on the recording data separated by the separation means and the drive pulse width signal generated by the signal generation means.

2. The head element substrate according to claim 1, wherein the data is configured such that respective recording data and drive pulse width data are periodically arrayed, and wherein the separation means separates the recording data using the data received by the receiving means and a clock which synchronizes with an array period of the recording data.

3. The head element substrate according to claim 2, wherein the separation means is formed using a shift register.

4. The head element substrate according to claim 1, wherein the data received by the receiving means is configured such that respective recording data and drive pulse width data are periodically arrayed, and wherein the signal generation means generates the drive pulse width signal by separating the drive pulse width data using the data received by the receiving means and a clock which synchronizes with an array period of the drive pulse width data.

5. The head element substrate according to claim 1, wherein the signal generation means is formed using a flip-flop circuit.

6. The head element substrate according to claim 1, wherein the receiving means receives a clock, the head element substrate further comprising:

a clock generation circuit configured to generate a plurality of clocks synchronizing with respective array periods of the recording data and the drive pulse width data based on the clock received by the receiving means.

7. The head element substrate according to claim 6, wherein the clock generation circuit is formed using a flip-flop circuit.

8. The head element substrate according to claim 1, wherein the receiving means comprises a differential signal receiving unit configured to receive low-voltage differential signal as the data.

9. A recording head provided with the head element substrate according to claim 1.

10. A head element substrate including a plurality of recording elements, the head element substrate comprising:

a receiving unit configured to receive data in which bits of drive pulse width data are interposed between bits of recording data;

a separation unit configured to separate the recording data from the data received by the receiving unit; and a signal generation unit configured to generate a drive pulse width signal which defines a power-on period of the plurality of recording elements by separating the drive pulse width data from the data received by the receiving unit, wherein the plurality of recording elements are driven based on the recording data separated by the separation unit and the drive pulse width signal generated by the signal generation unit.

* * * * *